US010014634B2

(12) United States Patent
Lin

(10) Patent No.: US 10,014,634 B2
(45) Date of Patent: Jul. 3, 2018

(54) HIGH SPEED NETWORK MODULE SOCKET CONNECTOR

(71) Applicant: JYH ENG TECHNOLOGY CO., LTD., New Taipei (TW)

(72) Inventor: Yen-Lin Lin, New Taipei (TW)

(73) Assignee: JYH ENG TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 15/787,719

(22) Filed: Oct. 19, 2017

(65) Prior Publication Data

US 2018/0115112 A1 Apr. 26, 2018

(30) Foreign Application Priority Data

Oct. 21, 2016 (TW) ..... 105216119 U

(51) Int. Cl.

| | |
|---|---|
| ***H01R 13/6466*** | (2011.01) |
| ***H01R 24/60*** | (2011.01) |
| ***H01R 13/405*** | (2006.01) |
| ***H01R 13/516*** | (2006.01) |
| *H01R 107/00* | (2006.01) |

(52) U.S. Cl.

CPC ..... *H01R 13/6466* (2013.01); *H01R 13/405* (2013.01); *H01R 13/516* (2013.01); *H01R 24/60* (2013.01); *H01R 2107/00* (2013.01)

(58) Field of Classification Search

CPC ..... H01R 13/6466; H01R 23/025; H01R 2107/00; H05K 1/0236

See application file for complete search history.

(56) References Cited

U.S. PATENT DOCUMENTS

| | | | | |
|---|---|---|---|---|
| 5,871,378 | A * | 2/1999 | Poiraud | H01R 4/2491 439/409 |
| 6,319,047 | B1 * | 11/2001 | Kang | H01R 43/015 439/404 |
| 6,511,344 | B2 * | 1/2003 | Winings | H05K 1/0228 174/250 |
| 7,086,909 | B2 * | 8/2006 | Colantuono | H01R 24/64 439/676 |
| 7,850,492 | B1 * | 12/2010 | Straka | H01R 13/6625 439/676 |
| 9,742,117 | B2 * | 8/2017 | Hashim | H01R 13/6467 |

(Continued)

*Primary Examiner* — Briggitte R Hammond
(74) *Attorney, Agent, or Firm* — Leong C. Lei

(57) ABSTRACT

A high speed network module socket connector is mounted in a housing and includes a circuit board, first terminals, second terminals, a base, and at least one crosstalk compensating element. The first terminals and the second terminals are fixedly connected to the circuit board and extend from two surfaces of the circuit board, respectively. The base is fixedly connected to the second terminals. The base has at least one cutout portion corresponding to the second terminals so that a part of each of the second terminals is exposed to the cutout portion. The crosstalk compensating element corresponds in shape and in size to the cutout portion. The crosstalk compensating element is mounted to the cutout portion of the base. The crosstalk compensating element is provided with contacts corresponding to a wiring layout. The contacts are in contact with the plurality of second terminals to form an electrical connection.

10 Claims, 7 Drawing Sheets

(56) References Cited

U.S. PATENT DOCUMENTS

| | | | | |
|---|---|---|---|---|
| 2008/0160837 | A1* | 7/2008 | Siemon | H01R 13/6463 439/676 |
| 2014/0073198 | A1* | 3/2014 | Moffitt | H01R 13/6461 439/676 |
| 2014/0342610 | A1* | 11/2014 | Hashim | H05K 1/0228 439/620.22 |
| 2017/0310052 | A1* | 10/2017 | Hashim | H01R 24/64 |

* cited by examiner

HIGH SPEED NETWORK MODULE SOCKET CONNECTOR

CROSS-REFERENCE TO RELATED APPLICATIONS

This non-provisional application claims priority under 35 U.S.C. § 119(a) on Patent Application No(s). 105216119 filed in Taiwan, R.O.C. on Oct. 21, 2016, the entire contents of which are hereby incorporated by reference.

FIELD OF INVENTION

The present invention relates to an electrical connector used for connecting with the high speed network, and more particularly to a high speed network module socket connector combined with a crosstalk compensating element to completely solve crosstalk when in use.

BACKGROUND OF INVENTION

1. Description of the Related Art

In the high speed digital communication era, electrical connectors used in a variety of electronic products play a very critical role for the interconnection and application of electronic systems. Especially, after a significant increase in network transmission rate, high-end digital products are developed continuously. For a variety of high-definition multimedia audio and video signals, the requirements for signal frequency and bandwidth become more and more strict. It is a great challenge for the design of the electrical connector as the digital signal transmission. As the transmission signal evolves from a single-ended signal into a differential signal, its characteristic is less susceptible to the noise from the power supply and adjacent circuit coupling and the electromagnetic interference of the external circuit. Thus, it can enhance the signal integrity and minimize the path loss encountered physically. But, the actual transmission path may include a slot line, a perforation and a connector, which is likely to cause attenuation or deterioration of the signal transmission.

In the high-speed interconnect network (Cat 6), adjacent signal lines often generate unnecessary high-frequency noises, or the electromagnetic environment will cause the electromagnetic phenomenon that deteriorates the system performance, called as crosstalk. However, when the crosstalk is higher than the allowable range of the standard, it may cause the system cannot work accurately. Especially, when the adjacent conductive lines are quite close to each other, the crosstalk will become a very serious problem that affects the reliability and signal integrity of the interconnection system, thus reducing the signal noise ratio and increasing the bit error rate. Furthermore, due to the internal circuit design of the plug of the network cable, the crosstalk between the differential signals is mainly from the capacitive coupling phenomenon.

At present, a conventional high speed network module socket connector uses eight curved terminals located at the front end as a conductor that is electrically connected to the plug of the network cable for signal transmission. Because the eight curved terminals are different from the twisted-pair conductive line of the network cable, it is easy to lead to a differential motion between the adjacent terminals to generate serious crosstalk. Therefore, how to reduce the near-end crosstalk caused in the area is a critical part for the design of the high speed network module socket connector.

The conventional high speed network module socket connector uses high-frequency measurement method to take the scattering parameters of the single-ended circuit and then calculates the required balance compensation between single-ended wire pairs. The printed circuit board is provided with the required compensation capacitor as a crosstalk compensating element to reduce the near-end crosstalk generated inside the high speed network module socket connector.

The most common design is to use the printed circuit board provided with a plurality of conductive terminals extending outward. The conductive terminals are electrically connected to the original curved terminals. For such a structural design, it is required to pay more attention to the precision when assembled, or the conductive terminals cannot effectively contact the original curved terminals to play its effectiveness. In addition, such a design increases the subsequent manufacturing cost, so it is necessary to be improved.

2. Summary of the Invention

In view of this, the primary object of the present invention is to provide a high speed network module socket connector. A hollow base is provided with a crosstalk compensating element. The crosstalk compensating element is electrically connected with the terminals in the base to improve near-end crosstalk when in use. In addition, the present invention further provides a retaining member for assembly. The crosstalk compensating element is fixed to a cutout portion in the base by a retaining cover or a retaining casing, thereby greatly improving the stability after assembled and enhancing the convenience of assembly.

In order to achieve the aforesaid object, the high speed network module socket connector of the present invention is mounted in a housing. The high speed network module socket connector comprises a circuit board, a plurality of first terminals, a plurality of second terminals, a base, and at least one crosstalk compensating element. The circuit board has a first surface and an opposing second surface. The circuit board is provided with a plurality of first electrical insertion holes and a plurality of second electrical insertion holes corresponding to a wiring layout. The plurality of first terminals are fixedly connected to the first electrical insertion holes, respectively. The first terminals extend toward the first surface. The plurality of second terminals are fixedly connected to the second electrical insertion holes, respectively. The second terminals extend toward the second surface. The base is fixedly connected to the second terminals. The second terminals are partially covered in the base. The base has at least one cutout portion corresponding to the second terminals so that a part of each of the second terminals is exposed to the cutout portion. The crosstalk compensating element corresponds in shape and in size to the cutout portion. The crosstalk compensating element is mounted to the cutout portion of the base. The crosstalk compensating element is provided with a plurality of contacts corresponding to the wiring layout. After assembled, the contacts are in contact with the plurality of second terminals to form an electrical connection for improving near-end crosstalk when in use.

In an embodiment, the cutout portion is in the form of a groove for accommodating the crosstalk compensating element therein. In addition, in order to increase the convenience of assembly and the stability after assembled, the high speed network module socket connector of the present invention further comprises a retaining cover. The base and the retaining cover have corresponding engaging members. The retaining cover is secured to the base to retain the crosstalk compensating element. Besides, the retaining cover has a plurality of retaining walls each corresponding to an interval between every two of the second terminals. The crosstalk compensation element has a plurality of notches corresponding to the retaining walls. After assembled, the retaining walls are inserted in the cutout portion so that the second terminals are spaced apart from one another by the retaining walls to avoid crosstalk effectively.

In another embodiment, both the first terminals and the second terminals of the present invention are arranged side by side in two rows, and the first terminals in the second row are located at two sides of the second terminals, respectively. Wherein, each of a top and a bottom of the base has the cutout portion corresponding to the second terminals in two rows. The two cutout portions are in the form of a groove for accommodating two crosstalk compensating elements therein. Furthermore, in order to increase the convenience of assembly and the stability after assembled, the high speed network module socket connector of the present invention further comprises a retaining casing. The retaining casing is secured to wrap the base so as to retain the two crosstalk compensating elements. In addition, the retaining casing has a plurality of retaining walls each corresponding to an interval of every two of the second terminals. The two crosstalk compensation elements each have a plurality of notches corresponding to the retaining walls. After assembled, the retaining walls are inserted in the cutout portion so that the second terminals are spaced apart from one another by the retaining walls to avoid crosstalk effectively.

In a further embodiment, the high speed network module socket connector of the present invention comprises a circuit board, a plurality of first terminals, a plurality of second terminals, a base, and a crosstalk compensating element. The circuit board has a first surface and an opposing second surface. The circuit board is provided with a plurality of first electrical insertion holes and a plurality of second electrical insertion holes corresponding to a wiring layout. The plurality of first terminals are fixedly connected to the first electrical insertion holes, respectively. The first terminals extend toward the first surface. The plurality of second terminals are fixedly connected to the second electrical insertion holes, respectively. The second terminals extend toward the second surface. The base is fixedly connected to the second terminals. The second terminals are partially covered in the base. The crosstalk compensating element is fixedly connected to the first surface of the circuit board. The crosstalk compensating element is provided with a plurality of contacts corresponding to the wiring layout. The contacts correspond in position to the plurality of second electrical insertion holes. The contacts are in contact with the plurality of second terminals to form an electrical connection for improving near-end crosstalk when in use.

DESCRIPTION OF THE PREFERRED EMBODIMENTS

The above and other objects, features and advantages of this disclosure will become apparent from the following detailed description taken with the accompanying drawings.

First Embodiment

Figure 1:
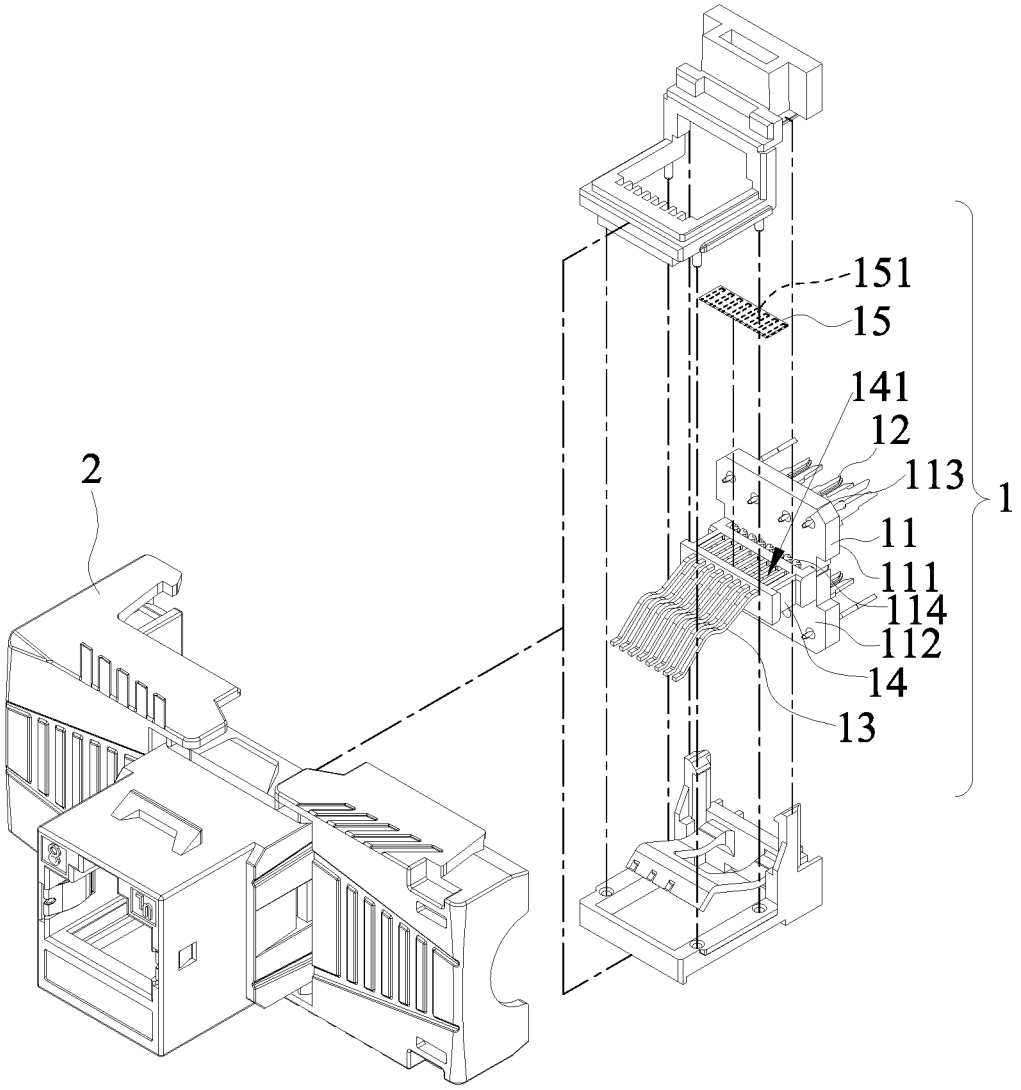
FIG. 1 is an exploded view in accordance with a first embodiment of the present invention.
Figure 2:
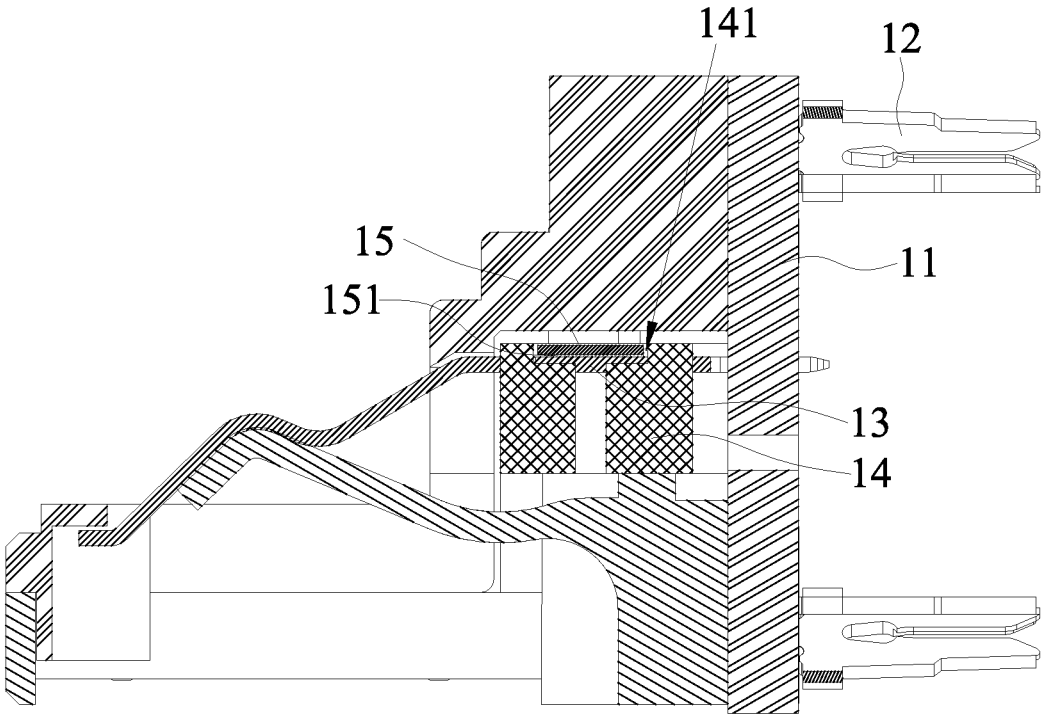
FIG. 2 is a sectional view in accordance with the first embodiment of the present invention after assembled.

FIG. 1 is an exploded view in accordance with a first embodiment of the present invention. FIG. 2 is a sectional view in accordance with the first embodiment. As shown in the drawings, the present invention discloses a high speed network module socket connector 1 mounted in a housing 2. The high speed network module socket connector 1 comprises a circuit board 11, a plurality of first terminals 12, a plurality of second terminals 13, a base 14, and a crosstalk compensating element 15.

Wherein, the circuit board 11 is in the form of a rectangular flat plate, and has a first surface 111 and an opposing second surface 112. The circuit board 11 is provided with a plurality of first electrical insertion holes 113 and a plurality of second electrical insertion holes 114 corresponding to a wiring layout. The second electrical insertion holes 114 are horizontally spaced apart. The first electrical insertion holes 113 are disposed at two sides of the second electrical insertion holes 114, that is, near the top edge and the bottom edge of the circuit board 11.

The first terminals 12 are fixedly connected to the first electrical insertion holes 113, respectively. The first terminals 12 extend toward the first surface 111 for electrically connecting with a signal line (not shown in the drawings).

The second terminals 13 are fixedly connected to the second electrical insertion holes 114, respectively. The first terminals 13 extend toward the second surface 112. The front ends of the second terminals 13 are bent forward and downward into a hook shape so as to be electrically connected to a plug of a network cable (not shown).

The base 14 is formed by insert molding and fixedly connected to the second terminals 13. The second terminals 13 are partially covered in the base 14. The base 14 has a cutout portion 141 corresponding to the second terminals 13. The cutout portion 141 is in the form of a groove so that a part of each of the second terminals 13 is exposed to the cutout portion 141.

The crosstalk compensating element 15 is a printed circuit board and corresponds in shape and in size to the cutout portion 141, and uses the same compensation capacitance means as the conventional technique to reduce the occurrence of near-end crosstalk. The crosstalk compensating element 15 is mounted in the cutout portion 141. The crosstalk compensating element 15 is provided with a plurality of contacts 151 corresponding to the wiring layout. The contacts 151 are implemented in the form of a welding pad located on the surface of the printed circuit board. After assembled, the contacts 151 are in contact with the plurality of second terminals 13 to form an electrical connection for improving the near-end crosstalk when in use. It should be noted that the crosstalk compensating element 15 of the present invention is not for all of the second terminals 13 to perform electrical connection, but for the most likely part that generates crosstalk to perform the wiring layout and to perform the electrical connection.

Second Embodiment

Figure 3:
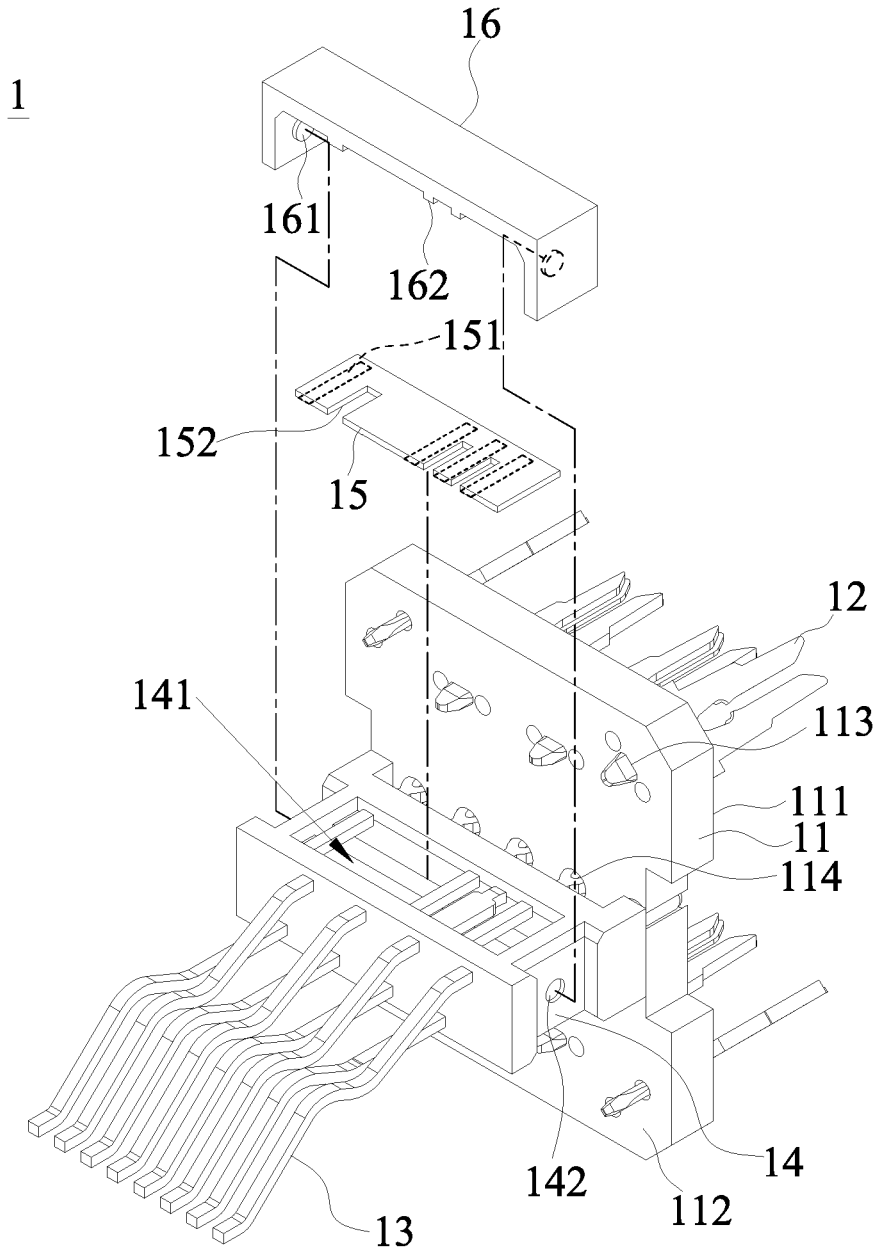
FIG. 3 is an exploded view in accordance with a second embodiment of the present invention.
Figure 4:
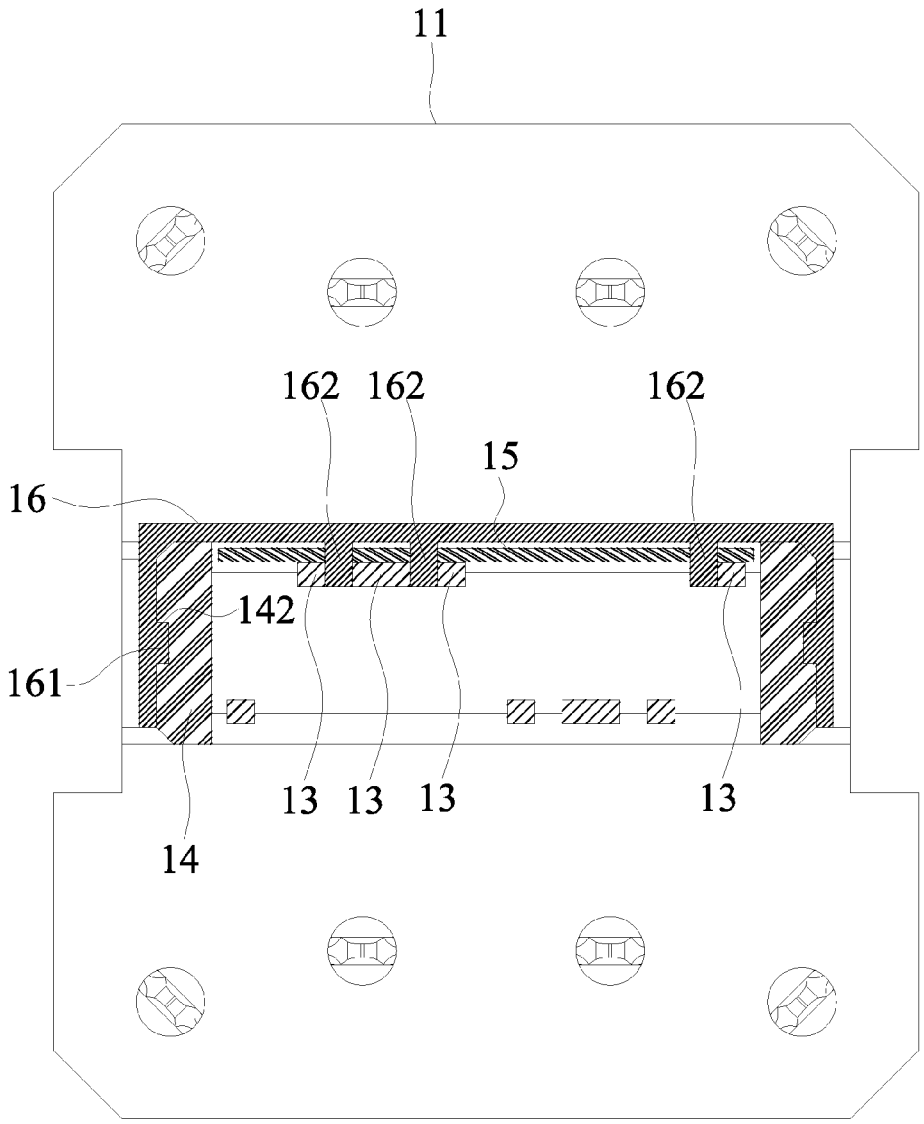
FIG. 4 is a sectional view in accordance with the second embodiment of the present invention after assembled.

FIG. 3 is an exploded view in accordance with a second embodiment of the present invention. FIG. 4 is a sectional view in accordance with the second embodiment. As shown in the drawings, in the second embodiment, the high speed network module socket connector 1 of the present invention further comprises a retaining cover 16. The retaining cover 16 is in the form of a reverse U-shaped frame. The base 14 and the retaining cover 16 have corresponding engaging members 142, 161 so that the retaining cover 16 is secured to the base 14. The crosstalk compensating element 15 is retained through the retaining cover 16. It should be noted that in order to further reduce the occurrence of crosstalk, the retaining cover 16 has a plurality of retaining walls 162 each corresponding to the interval of every two of the second terminals 13. The crosstalk compensation element 15 has a plurality of notches 152 corresponding to the retaining walls 162. After assembled, the retaining walls 162 are inserted in the cutout portion 141 so that the second terminals 13 are spaced apart from one another by the retaining walls 162. The adjacent two second terminals 13 do not have the chance to contact with each other.

Third Embodiment

Figure 5:
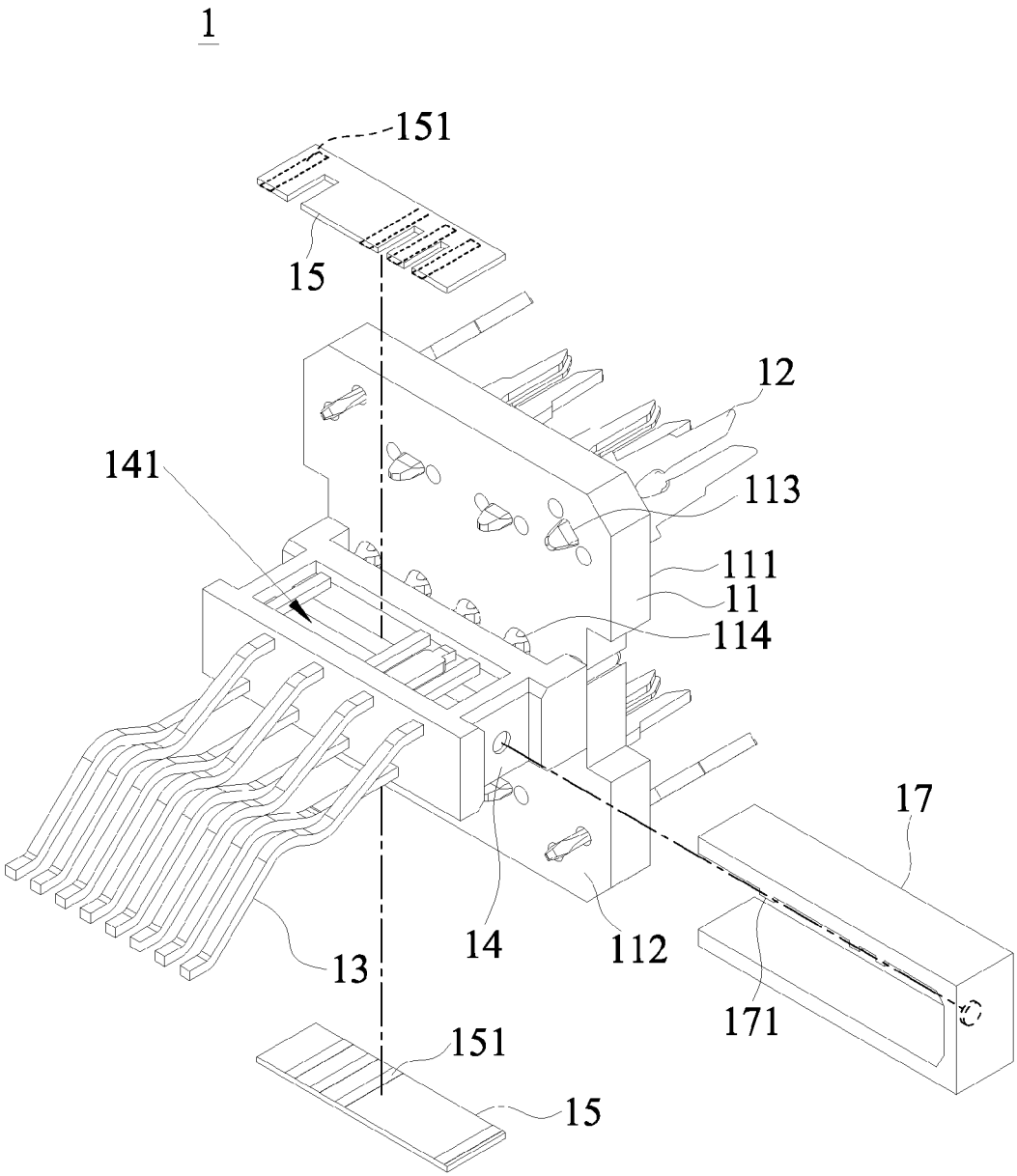
FIG. 5 is an exploded view in accordance with a third embodiment of the present invention.
Figure 6:
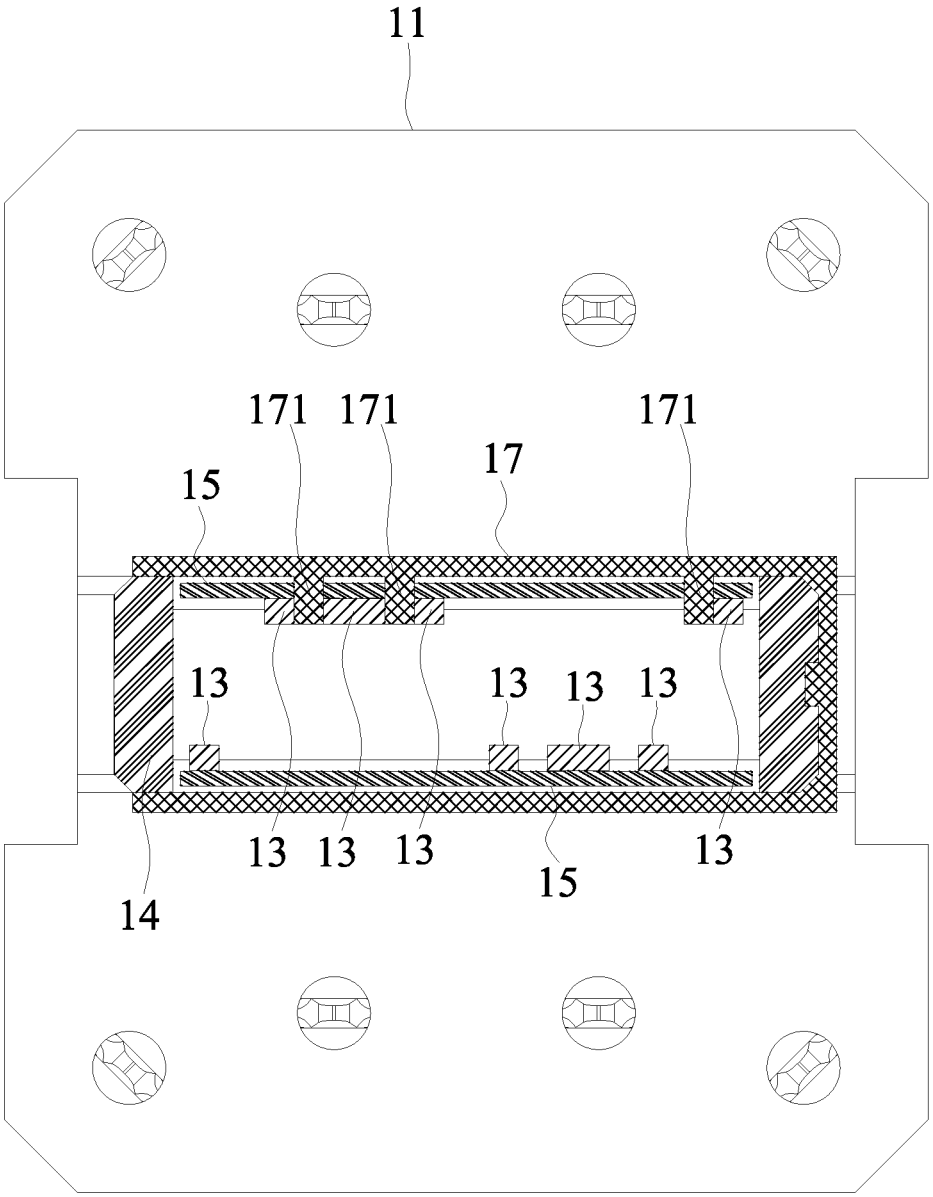
FIG. 6 is a sectional view in accordance with the third embodiment of the present invention after assembled.

FIG. 5 is an exploded view in accordance with a third embodiment of the present invention. FIG. 6 is a sectional view in accordance with the third embodiment. As shown in the drawings, in the third embodiment, the high speed network module socket connector 1 of the present invention is substantially similar to the second embodiment with the exceptions described hereinafter. Both the first terminals 12 and the second terminals 13 are arranged side by side in two rows. The first terminals 12 in the second row are located at two sides of the second terminals 13, respectively. Each of the top and the bottom of the base 14 has the cutout portion 141 corresponding to the second terminals 13 in two rows. Each of the two cutout portions 141 is mounted with the crosstalk compensating element 15. The two cutout portions 141 are in the form of a groove for accommodating the two crosstalk compensating elements 15 therein. In addition, in order to increase the convenience of assembly and the stability after assembled, the high speed network module socket connector 1 of the present invention further comprises a retaining casing 17. The retaining casing 17 is in the form of a reverse U-shaped frame. The retaining casing 17 is laterally secured to wrap the base 14 so as to retain the two crosstalk compensating elements 15. Furthermore, the retaining casing 17 has a plurality of retaining walls 171 each corresponding to the interval of every two of the second terminals 13. The two crosstalk compensation elements 15 each have a plurality of notches 152 corresponding to the retaining walls 171. The same effect as in the previous embodiment is achieved after assembled.

Fourth Embodiment

Figure 7:
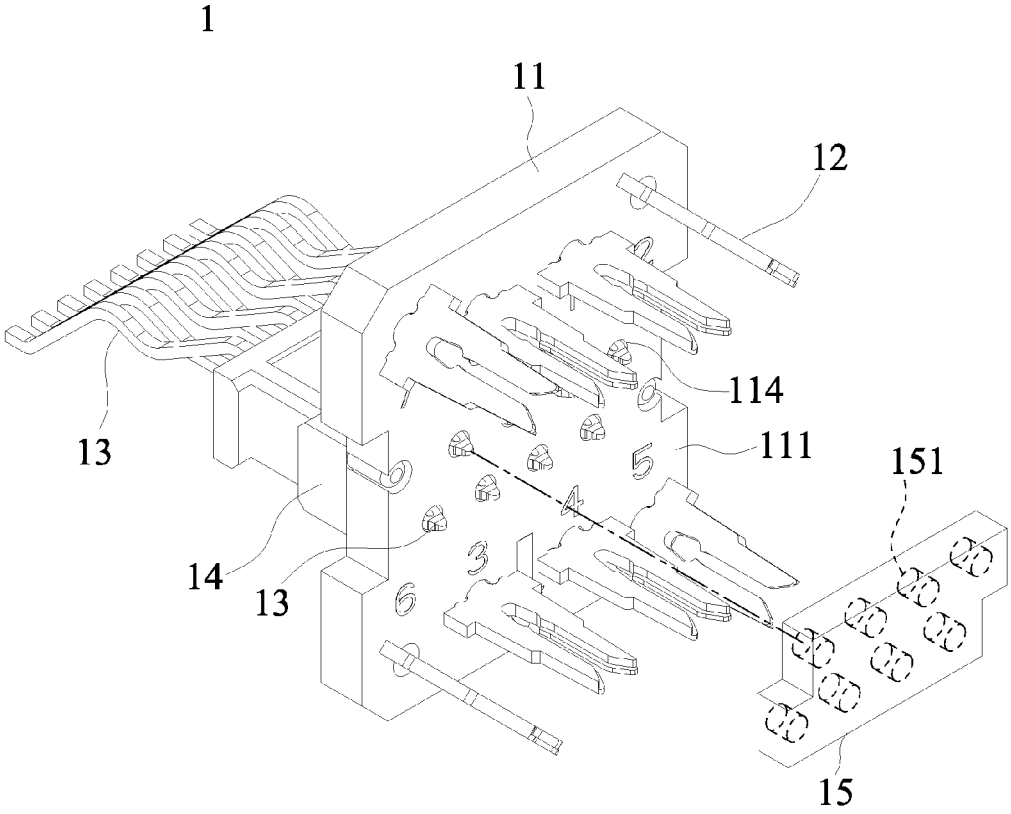
FIG. 7 is an exploded view in accordance with a fourth embodiment of the present invention.

FIG. 7 is an exploded view in accordance with a fourth embodiment of the present invention. As shown in the drawing, in the fourth embodiment, the high speed network module socket connector 1 of the present invention comprises the circuit board 11, the plurality of first terminals 12, the plurality of second terminals 13, the base 14 and the crosstalk compensating element 15. The main difference is the position of the crosstalk compensating element 15. The second terminals 13 are respectively inserted in the second electrical insertion holes 114 and each have a portion protruding out of the first surface 111. The crosstalk compensating element 15 is fixedly connected to the first surface 111, and the contacts 151 of the crosstalk compensating element 15 are in contact with the second terminals 13 so as to be electrically connected to the second terminals 13 for improving near-end crosstalk like the aforesaid embodiment.

While the invention has been described by means of specific embodiments, numerous modifications and variations could be made thereto by those skilled in the art without departing from the scope and spirit of the invention set forth in the claims.

What is claimed is:

1. A high speed network module socket connector, mounted in a housing, comprising:

a circuit board, having a first surface and an opposing second surface, the circuit board being provided with a plurality of first electrical insertion holes and a plurality of second electrical insertion holes corresponding to a wiring layout;

a plurality of first terminals, fixedly connected to the first electrical insertion holes respectively, the first terminals extending toward the first surface;

a plurality of second terminals, fixedly connected to the second electrical insertion holes respectively, the second terminals extending toward the second surface;

a base, fixedly connected to the second terminals, the second terminals being partially covered in the base, the base having at least one cutout portion corresponding to the second terminals so that a part of each of the second terminals is exposed to the cutout portion; and at least one crosstalk compensating element, the crosstalk compensating element corresponding in shape and in size to the cutout portion, the crosstalk compensating element being mounted to the cutout portion of the base, the crosstalk compensating element being provided with a plurality of contacts corresponding to the wiring layout, after assembled, the contacts being in contact with the plurality of second terminals to form an electrical connection for improving near-end crosstalk when in use.

2. The high speed network module socket connector as claimed in claim 1, wherein the cutout portion is in the form of a groove for accommodating the crosstalk compensating element therein.

3. The high speed network module socket connector as claimed in claim 2, further comprising a retaining cover, the base and the retaining cover having corresponding engaging members, the retaining cover being secured to the base to retain the crosstalk compensating element.

4. The high speed network module socket connector as claimed in claim 3, wherein the retaining cover has a plurality of retaining walls each corresponding to an interval between every two of the second terminals, the crosstalk compensation element has a plurality of notches corresponding to the retaining walls; after assembled, the retaining walls are inserted in the cutout portion so that the second terminals are spaced apart from one another by the retaining walls.

5. The high speed network module socket connector as claimed in claim 1, wherein both the first terminals and the second terminals are arranged side by side in two rows, and the first terminals in the second row are located at two sides of the second terminals, respectively.

6. The high speed network module socket connector as claimed in claim 5, wherein each of a top and a bottom of the base has the cutout portion corresponding to the second terminals in two rows for mounting the at least one crosstalk compensating element therein.

7. The high speed network module socket connector as claimed in claim 6, wherein the two cutout portions are in the form of a groove for accommodating two crosstalk compensating elements therein.

8. The high speed network module socket connector as claimed in claim 7, further comprising a retaining casing, the retaining casing being secured to wrap the base so as to retain the two crosstalk compensating elements.

9. The high speed network module socket connector as claimed in claim 8, wherein the retaining casing has a plurality of retaining walls each corresponding to an interval of every two of the second terminals, the two crosstalk compensation elements each have a plurality of notches corresponding to the retaining walls; after assembled, the retaining walls are inserted in the cutout portion so that the second terminals are spaced apart from one another by the retaining walls.

10. A high speed network module socket connector, mounted in a housing, comprising:

a circuit board, having a first surface and an opposing second surface, the circuit board being provided with a plurality of first electrical insertion holes and a plurality of second electrical insertion holes corresponding to a wiring layout;

a plurality of first terminals, fixedly connected to the first electrical insertion holes respectively, the first terminals extending toward the first surface;

a plurality of second terminals, fixedly connected to the second electrical insertion holes respectively, the second terminals extending toward the second surface;

a base, fixedly connected to the second terminals, the second terminals being partially covered in the base; and a crosstalk compensating element, fixedly connected to the first surface of the circuit board, the crosstalk compensating element being provided with a plurality of contacts corresponding to the wiring layout, the contacts corresponding in position to the plurality of second electrical insertion holes, the contacts being in contact with the plurality of second terminals to form an electrical connection for improving near-end crosstalk when in use.

* * * * *